US005694984A

United States Patent [19]

Cheung

[11] Patent Number: 5,694,984

[45] Date of Patent: Dec. 9, 1997

[54] STRAPPING TOOL WITH IMPROVED PUNCHES

[75] Inventor: Nelson Cheung, Hoffman Estates, Ill.

[73] Assignee: Illinois Tool Works Inc., Glenview, Ill.

[21] Appl. No.: 746,120

[22] Filed: Nov. 6, 1996

[51] Int. Cl.[6] ..... B21F 09/02

[52] U.S. Cl. ..... 140/152; 140/93.2

[58] Field of Search ..... 140/93.2, 93.4, 140/150, 152

[56] References Cited

U.S. PATENT DOCUMENTS 4,825,512 5/1989 Tremper et al. ..... 24/20

5,029,433 7/1991 Werk ..... 140/93.2

5,526,852 6/1996 Rakovski ..... 140/93.2

*Primary Examiner*—Lowell A. Larson

*Attorney, Agent, or Firm*—Donald J. Breh; Thomas W. Buckman; John P. O'Brien

[57] ABSTRACT

An improvement in a punch design for a punch used within a strapping tool which creates seal-less connections between overlapping steel strap segments that are to be bound together. The punch is relieved along the edge surfaces that experience extreme forces during the stamping operation which physically binds the strap segments together. The relieved edges also provide a less acute angle for the stamped edge surfaces to scrape against once the tension on the straps is released.

4 Claims, 3 Drawing Sheets

STRAPPING TOOL WITH IMPROVED PUNCHES

BACKGROUND OF THE INVENTION

1. Field of the Invention

This invention pertains to a strapping tool of the type used to apply a steel strap in a tensioned loop around a package which joins the strap through an series of interlocking joints that are comprised of interlocking shoulders punched into the overlapping ends of the strap by internal tooling punches so as to seal-lessly join the strap ends. This invention provides an improved punch design which increases the wear life of the punch and facilitates de-coupling between the punch and strap after the shoulders are formed.

2. Description of the Prior Art

Strapping tools of a type in wide-spread use are designed to tension the overlapped ends of a steel strap which are drawn from a supply and are wrapped around a package or load before interlockable shoulders are punched into the overlapped ends of a steel strap, wherein they are then cut from the supply. When the tool releases the joined straps from the tool, a tightly tensioned loop having such punched, interlocking shoulders is formed. A strapping tool of the type noted above is exemplified in Tremper et al. U.S. Pat. No. 4,825,512.

Most of the strapping tools of the type noted above are electrically or pneumatically powered and have separate motors for respectively tensioning the straps together and for punching and cutting the straps, while manually operated versions use lever-action to perform these same functions. Also typical of such tools is the availability of differing sizes of said tools to match varying widths and thicknesses of the steel strap. For example, it is common for straps of the type mentioned to have either ½ inch, ⅝ inch or ¾ inch widths and respective strap thicknesses of 0.015 inch to 0.025 inches. Recent trends have found much broader applications for such strapping and binding operations, and as a result, a necessity to use straps which are thicker, namely 0.025–0.031 inches, are needed to withstand the forces of larger loads.

With thicker strap requirements, it is critical to provide strapping tools which completely form the punched interlocking shoulders in order to ensure a full sealing of the straps; otherwise, a partially punched joint will compromise the integrity of the sealed package. However, it has been discovered that with the thicker gauge straps, more force per square inch is required to completely stamp the joints through both of the straps and such operation has been detrimentally affecting the strapping tool internal punches. FIG. 2 illustrates a perspective view of two straps having been punched and sealed together by the above-mentioned strapping tool. One familiar with punch and die operations can appreciate that when forming the short shoulders 18, 20 of the interlocking joint 16, a highly concentrated stamping load is experienced on the corresponding punch surfaces that form the shoulders. Moreover, those stamping forces are highly concentrated over a very small punch surface area. As a result of the concentrated punch stresses, the punch surfaces become spalled, thereby compromising the formation of the interlocking shoulders.

Another problem with the thicker straps is related to the higher tensioning loads that interlock the straps together after the joints are punched and released. As will become clearer later, the punched strap shoulders vertically scrape against corresponding edges on the punch as a result of the higher tensioning loads, eventually leading to spalling of the cornets of the punch shoulders.

SUMMARY OF THE INVENTION

It is the primary object of the present invention to provide an improved set of strapping machine tool punches which are not subject to spalling.

In accordance with the present invention, the improved punches of the kind used in the type of strapping machine previously discussed are provided with relieved edge surfaces on that part of the punch dedicated to stamping the shoulders of the interlocking joint.

The relieved shoulders eliminate highly concentrated compressive loads on the punches by distributing those same loads over a broader surface area. Furthermore, the relieved shoulders reduce the severity of the scrapping action occurring along the punch edges and the corners when the interlocking joints are removed from the punch.

BRIEF DESCRIPTION OF THE DRAWINGS

Other objects and advantages of the invention will become apparent upon reading the following detailed description and upon reference to the following drawings, in which.

DETAILED DESCRIPTION OF THE PREFERRED EMBODIMENT

Figure 1:
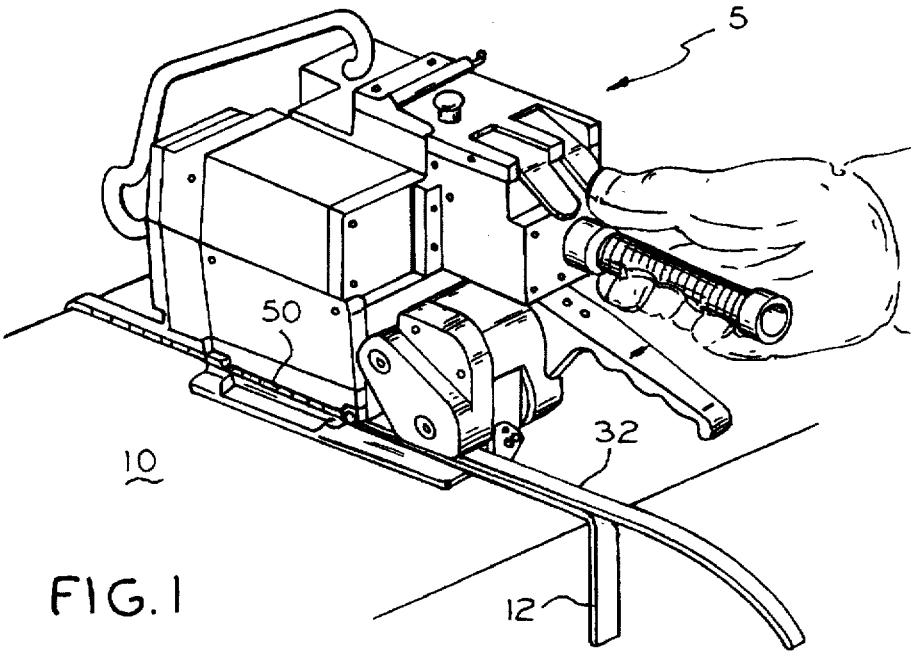
FIG. 1 is a perspective view of a strapping tool showing the relative position of both straps in respect to the punches used for forming a seal-less joint therein.
Figure 2:
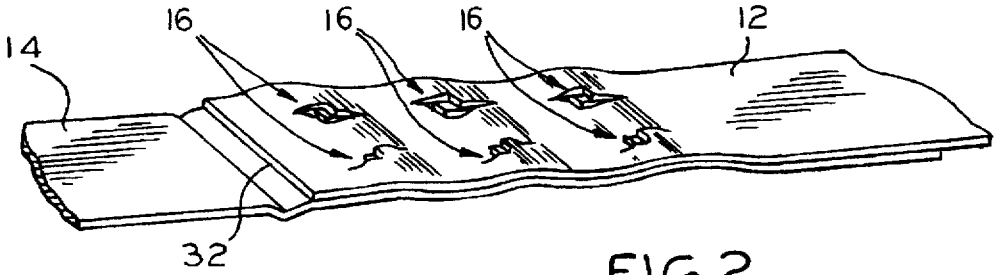
FIG. 2 is a perspective view showing the seal-less joints punched by the strapping machine of FIG. 1.

As shown in FIG. 1, a strapping tool or machine 5 of the type noted above is shown with two ends of steel strap inserted therein for joining together. The strapping tool 5 is used for applying the steel strap 12 in a tensioned loop around a package 10 by joining the two strap ends by means of several interlocking joints 16, as best seen in FIG. 2. A die (not shown) and punch 50 arrangement within the bottom of strapping tool 5 are part of a mechanism for admitting the overlapped end 32 into the tool, before the superposed strap ends are mechanically self-tensioned by one of two internal motors (not shown). The second motor controls operation of the punch and die arrangement so as to retain the overlapped ends and to simultaneously stamp a series of interlockable shoulders into each strap. Once the stamping operation is completed, the overlapped straps are now seal-lessly joined together and are released from tool 5.

Turning attention now to FIG. 2, it is seen that strap 12 now has a wave-like appearance immediate in the strap area that was exposed to the stamping operation; this appearance is the result of the punch and die interaction and has functional significance in the operation of the interlocking of the straps, as will become clearer shortly.

Figure 3:
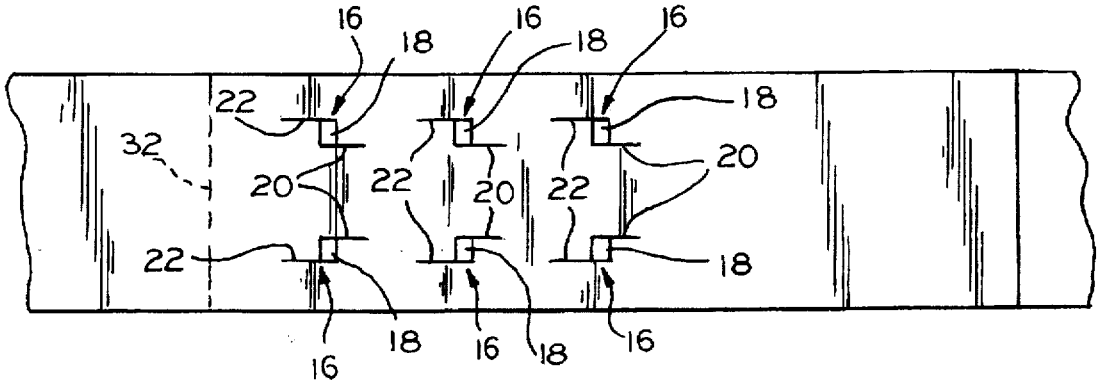
FIG. 3 is a top view of two superposed straps emphasizing the Z-shaped configuration of the interlocking shoulders that form the joints.
Figure 4:
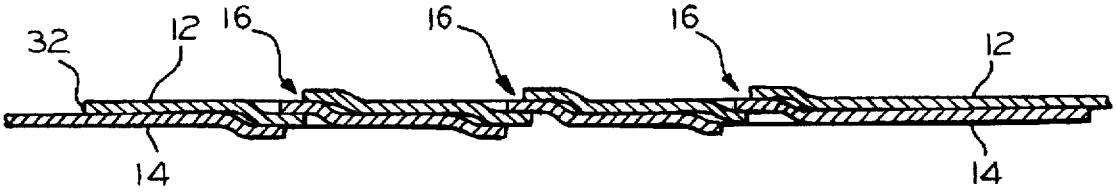
FIG. 4 is a sectional side view taken along line IV—IV of FIG. 3, with each strap in the interlocked position.

In accordance with known practice, the seal-less strap connection comprises six corresponding joints 16 which are arranged in side-by-side pairs so as to form two longitudinal rows. When viewing FIG. 3, it is seen that each joint 16 is defined by a similar Z-shaped slit 22 formed into upper strap end 12 and lower strap end 14, of which a part of said Z-shape is downwardly configured during the stamping operation so as to create the wave-like appearance seen in FIG. 2. Each joint 16 is comprised of a short shoulder 18 and a long shoulder 20. It should be understood that reference characters 18 and 20 will refer to shoulders of the joint formed in the upper strap end 12, while the reference characters 24 and 26 will refer to the short and long shoulders of the joint formed on the lower strap end 14. The above-described shoulders on each strap segment are adapted to interlock with each other when the segments are released under tension by tool 5, thereby longitudinally shifting ends 12 and 14 with respect to each other so that, the Z-shaped joints 16 interlock together and form the seal-less joint. FIG. 4 illustrates a longitudinally shifted set of strap ends 12, 14, where joints 16 are shown "locked". The wave-like profile in the joined straps (FIG. 2) helps to promote and maintain the interlocking of the shoulders.

Figure 5:
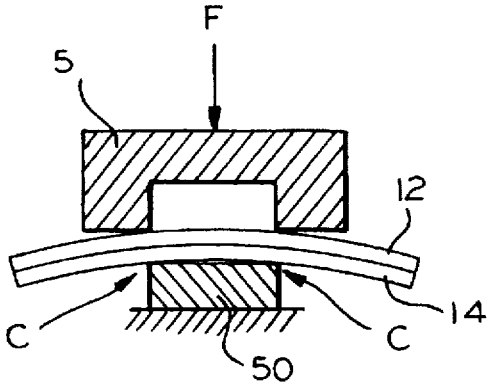
FIG. 5 is an end sectional view of a simplified prior art punch and die arrangement emphasizing the concentration of punching forces on the outer punch edges.
Figure 6:
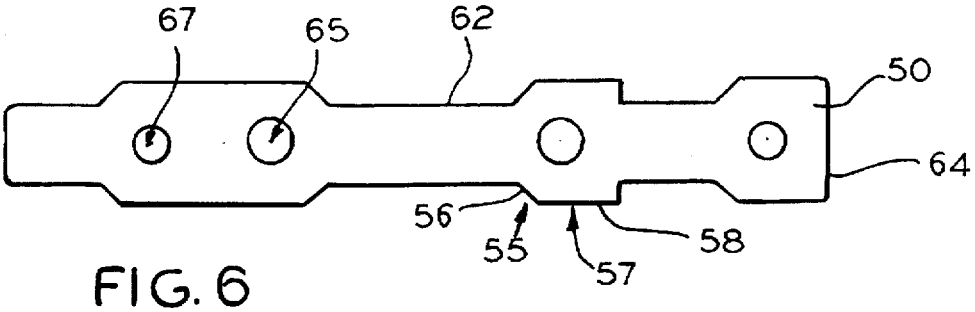
FIG. 6 (PRIOR ART)
FIG. 6 is a top view of a prior art punch used in the strapping tool of FIG. 1 to form the Z-shaped interlocking shoulders.
Figure 7:
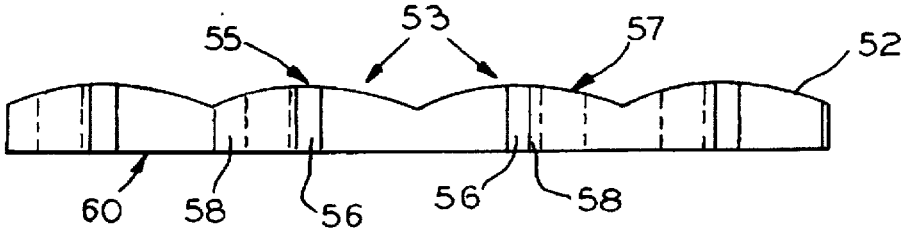
FIG. 7 (PRIOR ART)
FIG. 7 is a side view of the punch shown in FIG. 6.

FIG. 6 is intentionally shown positioned below FIG. 4 so that a general correlation can be made between the punch surfaces and the Z-shaped slits, as well as the wave-like profile remaining in the straps after stamping. FIG. 7 is a side view of the punch of FIG. 5, and it is seen that punch 50 has a generally planar bottom surface 60 for attaching to machine 5 through guidepins and screws (not shown) which respectively interact with throughbores 65 and threaded holes 67; these holes pass from bottom wall 60 to top surface 52. The top wall 52 is defined by a series of arcuate, interconnecting segments 53 that also interconnect with side walls 62 and end walls 64. The side walls each have opposed protuberances formed thereon which are defined by a long wall 58 and a short wall 56. The long and short walls also define respective long and short top edge surfaces 57, 55 where top wall 52 joins side walls 62. When punch 50 and the die (not shown) interact, it can be appreciated that the superposed strap ends 12, 14 are physically stamped so as to be advanced downwardly against top surface 52, and correspondingly against punch short and long edges 55, 57 of short and long walls 56, 58, respectively. When fully compressed against punch top surface 52, each punch short edge and long edge 55, 57, cuts the Z-shaped slit simultaneously into each of upper and lower strap ends 12, 14. As was previously disclosed, however, when strap thicknesses are increased, the compressive forces necessary to shear each strap into a Z-shaped slit becomes substantial. As FIG. 5 illustrates, a highly concentrated compressive load occurs at the outer corners. In particular, edges 55 and 57 experience extreme line-loaded compressive forces, especially along the relatively shorter edges 55, causing them to become spalled after a relatively short period of use. The spalled edges entirely compromise the integrity of the seal-less joints.

Figure 8:
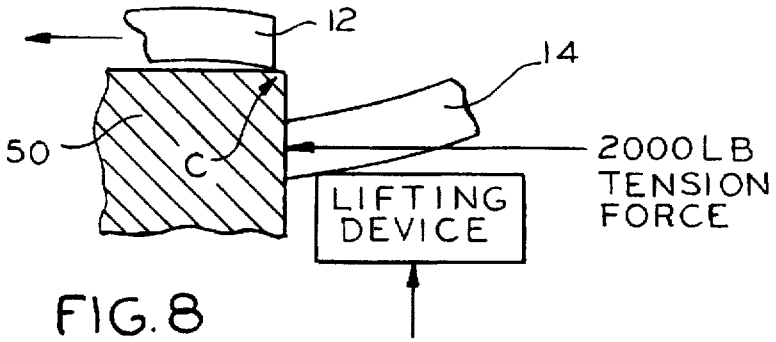
FIG. 8 is a partial side view in section of a simplified punch and die arrangement of the present invention showing the outer punch edges being subjected to scrapping action under strap tension release.

Relatedly, it was also discovered that even if the punches are not spalled from stamping, the straps will nevertheless experience difficulties in de-coupling or releasing from the punch after stamping is performed; this condition is mainly experienced when the strap thickness is between 0.025 and 0.031 inches. Over time, it was also found that the de-coupling problems also lead to spalling of edges 55 and 57, especially at the corners, designated by the letter C, where the two edges meet. By viewing FIG. 8, it is seen that as the stamped strap is pushed upwardly and off punch 50 by a lifting device in strapping machine 5, the edge of the newly-cut strap severely scrapes against the punch at the outer corners, caused by the high tensile force (up to 2000 lbs.) held on each strap, causing chipping and spalling at the 90° corners C.

Figure 9:
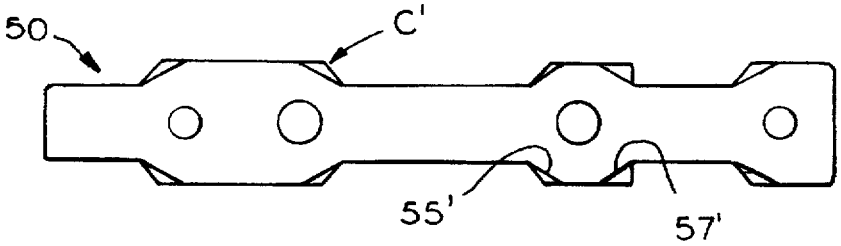
FIG. 9 is a top view of the punch of the present invention showing the relieved punch edges on the shoulders of the punch which form interlocking Z-shaped slits.
Figure 11:
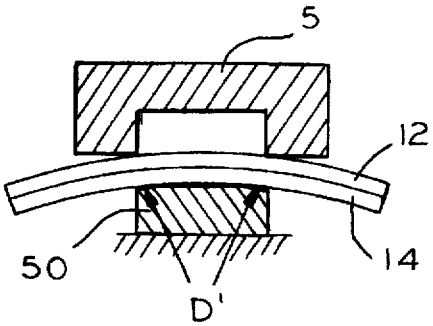
FIG. 11 is an end sectional view of a simplified punch and die arrangement of the present invention emphasizing that strap cutting starts at the stronger, inside corners of the punch.
Figure 10:
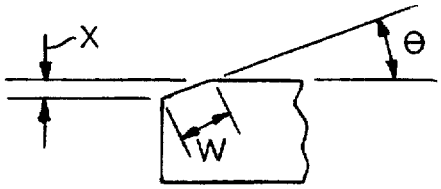
FIG. 10 is a fragmented sectional view of one of the relieved edges identified in FIG. 9.
Figure 12:
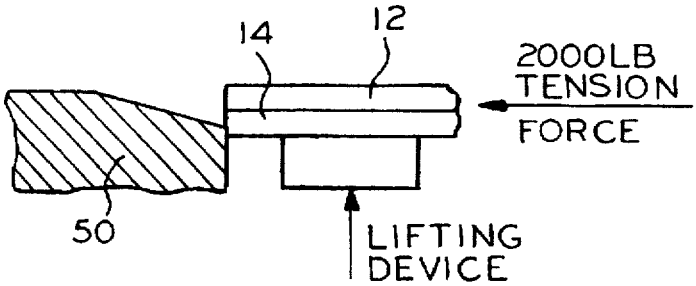
FIG. 12 is a partial side view showing the less acute angle for scrapping after release of the strap tension.

In order to overcome the above-described difficulties, punch 50 was provided with relieved corners C', which are defined by relieved or extended short and long edges 55' or 57' on each of the walls 56 and 58 that were shown in FIG. 6, as best seen from viewing FIGS. 9 and 10. When comparing the punch of the present invention (FIG. 9) to the prior art punch that experiences spalling (FIG. 6), it is seen that the short edges 55' and a part of the long edges 57' now include a much wider edge surface. In this way, the extreme compressive stamping forces are no longer concentrated only along the discrete outside edge of the punch. Rather, they are now distributed along a much larger edge surface area, and as FIG. 11 illustrates, the cutting of the slits actually starts towards the inside corners D' of the punch, where stronger, and larger edge surfaces lie. Relief of these surfaces thereby eliminates the spalling problems caused solely by stamping. Furthermore, as FIG. 12 shows, whenever the edges are relieved, a less acute angle (less than 90°) is formed on the punch, also favorably eliminating the chipping and spalling problems related solely to the strap tensioning forces during strap release. As FIG. 10 shows, it is preferable to provide said relief at an angle θ of up to 10°, and to a depth X of about 0.015 inches. In this way, stamping forces are now distributed across the wider surface edge area W, without compromising the ability of punch 50 to properly form the Z-shaped slits that eventually create each joint 16. It should be clear that the angle of θ is greater than 10°, the relief surface edge area W will become smaller.

Thus, it is apparent that there has been provided in accordance with the invention, a relieved punch surface that fully satisfies the objects and aims, as set forth above. While the invention has been described in conjunction with a specific embodiment thereof, it is evident that alternatives, modifications, and variations will be readily apparent to those skilled in the art in light of the foregoing description. Accordingly, it is intended to enhance all such alternatives, modifications and variations as set forth within the spirit and broad scope of the following claims.

I claim:

1. An improved punch for use with a die in a strapping tool that joins superposed upper and lower strap ends through formation of a series of longitudinally displaced interlocking shoulders stamped into each of said strap ends, said punch defined by a planar bottom wall, a top wall, a first and a second end wall interconnecting said top and bottom walls, and a first and a second side wall interconnecting with said top, bottom and end walls, said connection between said top and side walls defining a respective first and second top edge surface, and each of said side walls having a plurality of opposed and like protuberances projecting therefrom and extending between said top and bottom walls, said protuberances for forming said interlocking shoulders in said strap segments, each of said protuberances formed by at least one short wall and at least one long wall, said short wall disposed at a generally acute angle with respect to a longitudinal direction, said long wall disposed generally parallel to said side wall, wherein said long wall and short wall form a generally Z-shaped slit in said strap segments when said punch interacts with said die, the improvement comprising said top edge surface along said short wall of each of said protuberances having a relief formed thereon in order to provide an extended top edge surface which is not prone to spalling when said punch forms said interlocking shoulders.

2. The improved punch of claim 1 wherein said relief is cut into each said protuberance short walls in a like fashion, from said top wall at an acute angle from said top wall of said punch.

3. The improved punch of claim 2 wherein said relief extends in a downward direction from said top wall of said punch, said relief extending vertically downward from said top wall such that said acute angle is no greater than 10°.

4. The improved punch of claim 3 wherein said relief is provided solely on said first and second top edge surfaces of said punch.

* * * * *